US005419300A

United States Patent [19]

Maruyama et al.

[11] Patent Number: 5,419,300

[45] Date of Patent: May 30, 1995

[54] IGNITION COIL UNIT WITH IGNITION VOLTAGE DETECTIVE CAPACITOR FOR INTERNAL COMBUSTION ENGINE

[75] Inventors: Shigeru Maruyama; Yuichi Shimasaki; Masaki Kanehiro; Takashi Hisaki; Shigeki Baba; Takuji Ishioka; Jiro Takagi; Eitetsu Akiyama, all of Saitama, Japan

[73] Assignee: Honda Giken Kogyo Kabushiki Kaisha, Tokyo, Japan

[21] Appl. No.: 149,628

[22] Filed: Nov. 9, 1993

[30] Foreign Application Priority Data

Nov. 10, 1992 [JP] Japan ..... 4-326166
Nov. 17, 1992 [JP] Japan ..... 4-330982
Nov. 17, 1992 [JP] Japan ..... 4-330983
Nov. 17, 1992 [JP] Japan ..... 4-330984

[51] Int. Cl.[6] ..... F02P 17/00; F02P 3/02

[52] U.S. Cl. ..... 123/634; 123/635; 324/399; 324/402; 336/96; 361/270

[58] Field of Search ..... 123/143 C, 169 PA, 634, 123/635, 643, 630; 361/270; 324/393, 399, 402; 336/69, 96

[56] References Cited

U.S. PATENT DOCUMENTS 1,303,162 5/1919 Cavanagh ..... 361/270
1,946,631 2/1934 Loudon ..... 361/270
2,394,768 2/1946 Harkness ..... 361/270
3,566,202 2/1971 Carr ..... 361/270
3,742,312 6/1973 Hillyard ..... 361/270
5,349,930 9/1994 Maruyama et al. ..... 123/143 C

FOREIGN PATENT DOCUMENTS 52-118135 10/1977 Japan .
5-65868 3/1993 Japan .

*Primary Examiner*—Tony M. Argenbright
*Attorney, Agent, or Firm*—Nikaido, Marmelstein, Murray & Oram

[57] ABSTRACT

An ignition coil unit for an internal combustion engine for containing an ignition voltage detective capacitor for misfire discrimination, including a core, a primary and a secondary coil wound around the core, and a case housing the core and the primary and secondary coils which is filled with an insulative material. In this unit, a first conductive electrode plate is placed in the case and electrically connected with the output of the secondary coil, and a second conductive electrode plate is also placed in the case in parallel with the first conductive electrode plate while maintaining a predetermined distance therefrom. An insulator is interposed between the first and second conductive electrode plates forming a capacitor that uses the insulator as the dielectric. When the first plate is fixed to the coil's bobbin at a position close to the secondary coil's higher voltage end such that it cantilevers therefrom, a partition or the like is interposed between the plates so as to prevent the first plate from interfering with the second plate.

20 Claims, 20 Drawing Sheets

IGNITION COIL UNIT WITH IGNITION VOLTAGE DETECTIVE CAPACITOR FOR INTERNAL COMBUSTION ENGINE

BACKGROUND OF THE INVENTION

1. Field of the Invention

This invention relates to a technology for detecting misfire occurring during operation of a gasoline or other spark-ignition internal combustion engine, and more particularly, to an ignition coil unit with a capacitor for detecting ignition voltage to be used in such misfire detection.

2. Description of the Prior Art

As is well known, in gasoline and other types of internal combustion engines, a high voltage produced by an ignition coil is distributed to spark plugs at the engine cylinders by an ignition distributor. At each cylinder, the resulting electric discharge between the spark plug electrodes produces a spark which ignites an air-fuel mixture that has been drawn into the cylinder and compressed at the proper time, causing the mixture to burn explosively. In the course of this ignition-combustion process, the mixture may for some reason occasionally fail to burn properly. This is referred to as a misfire. Misfires can result from causes in either the fuel supply system or the ignition system. Misfires caused by problems in the fuel supply system are the result of an overly lean or overly rich air-fuel mixture. At that instance, a spark is produced between the spark plug electrodes but the air-fuel mixture does not ignite. Misfires caused by problems in the ignition systems are the result of spark plug electrodes fouling or ignition circuit malfunctions, either of which may prevent normal spark discharge.

The occurrence of misfire in the course of engine operation not only degrades engine performance but may also degrade fuel efficiency. It may further cause after-firing of unburned gases in the exhaust system, which can affect the exhaust emission control system and have other adverse effects. Moreover, since the occurrence of even a single misfire indicates a misadjustment or malfunction in the fuel supply system or ignition system, prompt elimination of the problem is essential. Because of this, there is a strong need for development of a detector for detecting misfires as soon as they occur.

One type of misfire detector that has been proposed is the mis-spark detector described in Japanese Laid-open Patent Publication No. 52(1977)-118135. As shown in FIG. 21, the detector includes a conductor 51 wrapped around a portion of a high-voltage (high tension) cable 50 of the engine ignition system so as to constitute a detective capacitor 52 (a type of capacitance probe) in which the insulation cladding 50A of the high-voltage cable 50 serves as the dielectric. A voltage divider capacitor 53 is connected between the capacitor 52 and the ground so that the ignition voltage (secondary voltage of the ignition coil) applied to the conductive core 50B of the high-voltage cable 50 induces a voltage across the terminals of the capacitor 52 owing to its static capacitance. The induced voltage is statically divided by the capacitor 52 and the capacitor 53, and the voltage across the terminals of the capacitor 53 (the divided voltage) is forwarded as a detection voltage to an electronic circuit 54 for processing and discrimination. The electronic circuit 54 discriminates the occurrence of misfires from the difference between the wave form of the ignition voltage at the time of normal spark discharge and that at the time of no spark discharge (mis-sparking). Among the different types of misfires, the detector thus detects misfires that occur when no spark discharge is produced owing to a problem in the ignition system.

Another detector for detecting misfire in internal combustion engines is disclosed in the present assignee's Japanese Laid-Open Patent Publication No. 5(1993)-65868. In this detector, the ignition voltage is similarly detected from a high-voltage cable or the like of the ignition system using static voltage division, and misfiring owing to causes in the fuel supply system is detected based on the fact that, even when spark discharge occurs, the wave form of the ignition voltage differs between the case where normal combustion occurs and the case where it does not.

In conventional misfire detectors, a "capacitance probe" is used as a means for detecting ignition voltage. This probe is constituted by wrapping a sheet or ribbon of conductor around the high-voltage cable of the ignition system, so as to form a detective capacitor between the conductor and the core of the high-voltage cable using insulation cladding of the high-voltage cable as the dielectric. However, the capacitance probe constituted in this manner has a major drawback that derives from the nature of the high-voltage cable of the ignition system. Because of its flexibility and elasticity, the high-voltage cable is highly susceptible to vibration. It is also easily affected by changing ambient humidity, wetting by leaking water, and fouling with oil, grime and the like. When a capacitor for use in detection is formed by wrapping a conductor ribbon around the cable, the static capacitance of the capacitor is apt to be changed from its proper value by a shifting of the conductor caused by vibration, as well as by changing humidity, wetting with water, and fouling with oil, grime and the like. Although some change in static capacitance can be tolerated if the capacitor is to be used only for checking the ignition voltage, even slight changes have to be avoided when it is used for misfire detection, because such detection generally requires accurate detection not only of the ignition voltage but also of the ignition voltage wave form. The capacitance changes to which the prior art capacitance probe is susceptible, may alter the detected voltage wave form, and thereby make it impossible to detect misfire with high reliability.

In addition, the insulation cladding of the high-voltage cable is generally formed of synthetic rubber, a material that is readily degraded when exposed to heat and/or fouled with oil and grime. This degradation of the insulation cladding after the detection capacitor has been formed by winding the conductor around the high-voltage cable not only produces a progressive change in the static capacitance of the capacitor over time, but may also reduce the electric insulation property of the cladding to the point that the high ignition voltage can leak to the conductor wrapped around it. When this happens, the high leak voltage is apt to be conducted to the electronic circuitry of the misfire detector, which it can damage or cause to malfunction.

In actual practice, moreover, the flexibility and elasticity of the high-voltage cable make the work of attaching the conductor for forming the capacitor on the insulation cladding of the high-voltage cable and securing it thereon difficult and troublesome. Maintenance of the so-formed capacitor is also troublesome.

In order to solve these problems, the present assignee proposed an ignition coil unit in an application filed in the United States on Apr. 26, 1993 having Ser. No. 08/051,668, in which the conductor, which constitutes the capacitor for detecting ignition voltage, is embedded in the insulative resin that fills the ignition coil unit case. More specifically, it is an ignition coil unit having a metallic core, a primary coil and a secondary coil wound around the core, a first connector section for supplying a primary current to the primary coil, and a second connector section for extracting a secondary current carrying a high voltage to the exterior; all of which are molded integrally in the unit case by an insulative resin material. The detective conductor is located around a conductor constituting the second connector section, maintaining a predetermined therefrom and so forming the detective capacitor therewith.

With this arrangement, since the detective conductor, constituting a part of the detective capacitor for detecting the ignition voltage, is provided in the structurally sturdy ignition coil unit case, differently from the conventional arrangement in which the detective conductor is provided on a high-voltage cable of the ignition system, there is no danger of positional shifting of the detective conductor due to mechanical vibration, or of it being affected by ambient humidity, wetting by leaking water, or fouling with oil or grime. The detective capacitor is thus kept free from the change in its static capacitance, and the wave form of the ignition voltage can therefore be accurately detected at all times. Further, the material to be used as the insulator (dielectric) intervening between the detective conductor and the secondary connector section's inner conductor is not limited to materials such as rubber or the like used in the conventionally arrangement, which are highly susceptible to degrading. Instead, it becomes possible to use the resin used in the ignition coil unit fabrication, or a ceramic; either of which has excellent structural durability. It therefore becomes possible to prevent leaking of the aforesaid high voltage, which would otherwise cause damage to or a malfunction of the misfire detector. Furthermore, since the conductor is disposed integrally in the coil unit case at the time of molding it, it can eliminate the tedious attaching or assembling work and the troublesome maintenance previously required.

With the arrangement proposed in the earlier application, it becomes possible to solve the problems experienced in the conventional arrangement in which the detective conductor is provided on the high voltage cable.

Aside from the above, when using the capacitance probe technique, a detected voltage and hence the detection accuracy will increase with increasing capacitance of the detective capacitor. In the arrangement proposed in the earlier application, however, it is difficult in practice to increase the capacitance of the detective capacitor, and hence, it may not be necessarily sufficient for accurate detection.

More specifically, the capacitance is determined by the area of and the distance between opposed electrodes; i.e., the capacitance and hence the detection accuracy increases with decreasing distance or increasing area. In the arrangement proposed in the earlier application, however, since the detective conductor is located around the secondary connector section's conductor at a fixed distance so as to form the detective capacitor therewith, in order to increase the capacitance and enhance the detection accuracy, it becomes necessary to decrease the distance between the detective conductor and the secondary connector section's conductor, or to increase the area of the conductors. However, it is not easy to decrease the distance between the conductors due to problems such as corona discharge, current leakage, or possible deformation of the detective conductor which could occur at the time of injecting a resin in the coil unit case. As regards the area, on the other hand, it is determined by the outer diameter of the secondary connector section's conductor, and such diameter is determined by that of connectors widely used and easily available in the market. It is possible, needless to say, to choose a particular connector having greater outside diameter. However, the choice will not only invite the increase in cost of the connector itself, but also require the change in design or configuration in the other parts, resulting further increases in cost.

SUMMARY OF THE INVENTION

Therefore, an object of the invention is to provide an ignition coil unit with a capacitor for detecting ignition voltage in an internal combustion engine, which enables it to increase the capacitance of the detective capacitor in order to enhance detection accuracy, but without creating any substantial change in design or configuration of the unit.

For realizing these objects, the present invention provides an ignition coil unit for an internal combustion engine, including, a core, a primary coil and a secondary coil wound around the core, and a case housing the core and the primary and secondary coils and filled with an insulative material. The improvement comprises, a first conductive electrode plate placed in the case and electrically connected with the output of the secondary coil, a second conductive electrode plate placed in the case in parallel with the first conductive electrode plate while maintaining a predetermined distance therefrom, and an insulator interposed between the first and second conductive electrode plates such that a capacitor is formed therewith using the insulator as a dielectric.

BRIEF DESCRIPTION OF THE DRAWINGS

These and other objects and advantages of the invention will be more apparent from the following description and drawings, in which.

DETAILED DESCRIPTION OF THE PREFERRED EMBODIMENTS

Figure 1:
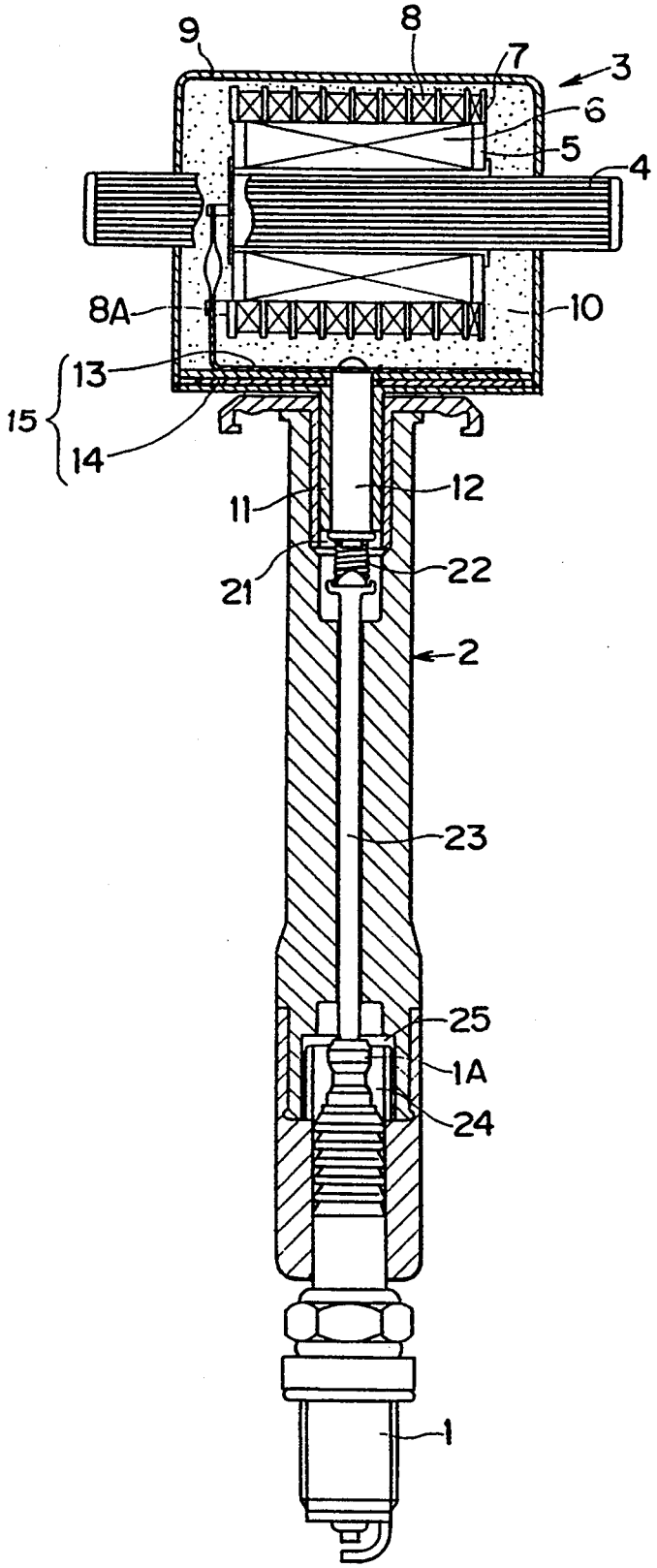
FIG. 1 is a cross sectional front view of an ignition coil unit with an ignition voltage detective capacitor for an internal combustion engine according to a first embodiment of the invention.
Figure 2:
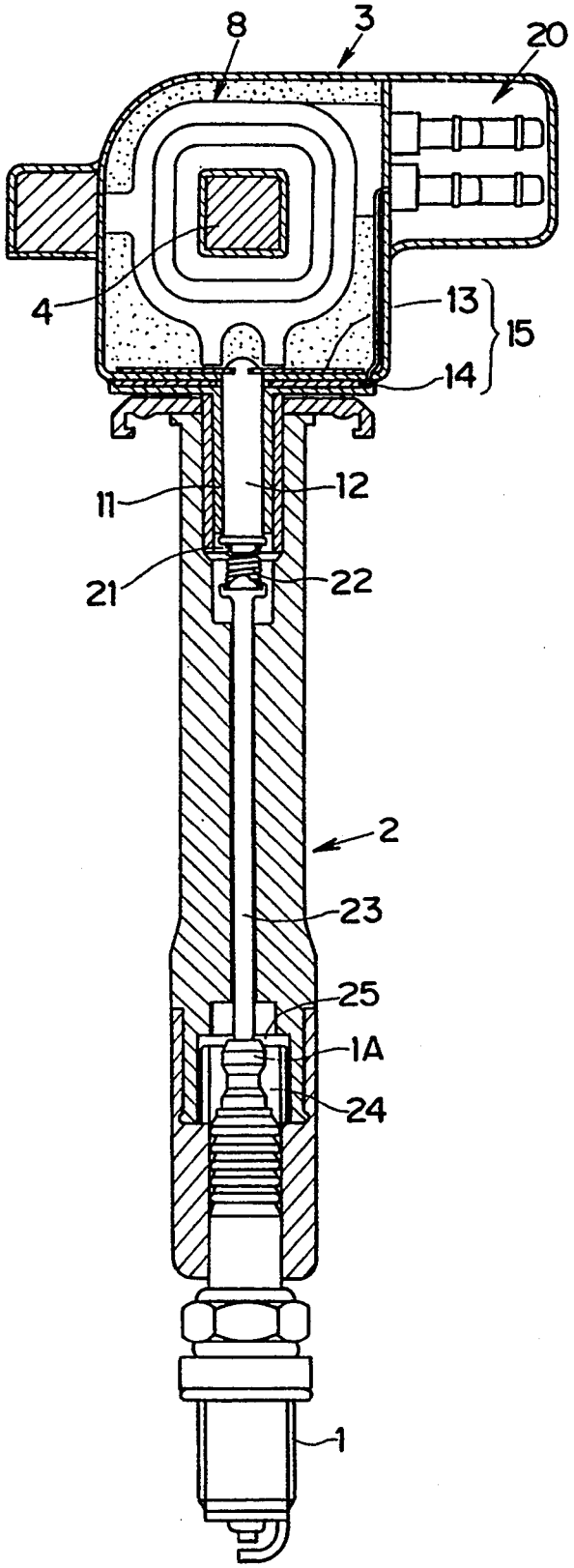
FIG. 2 is a cross-sectional side view of the ignition coil unit illustrated in FIG. 1.
Figure 3:
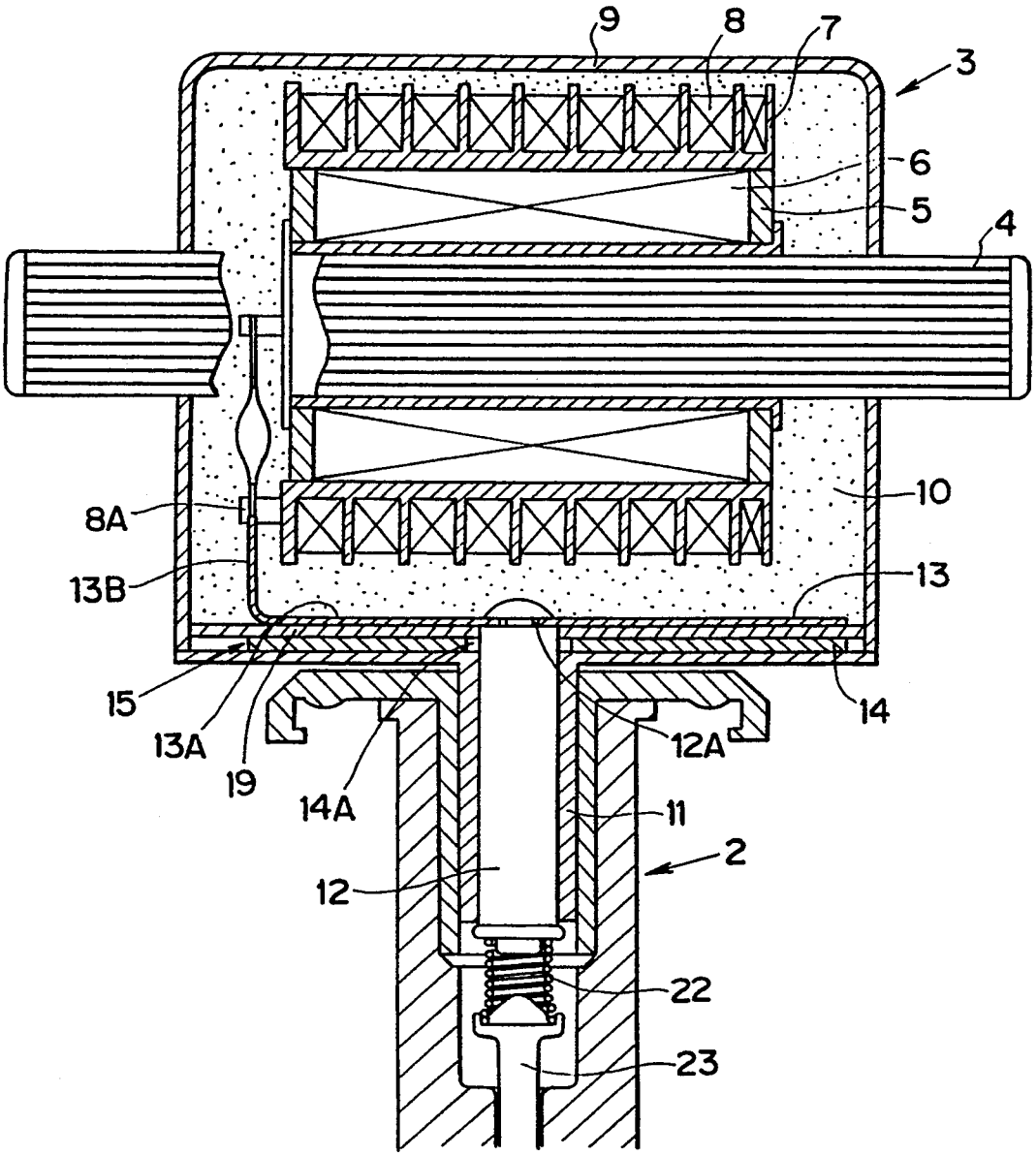
FIG. 3 is a front view enlarging a portion of FIG. 1.
Figure 4:
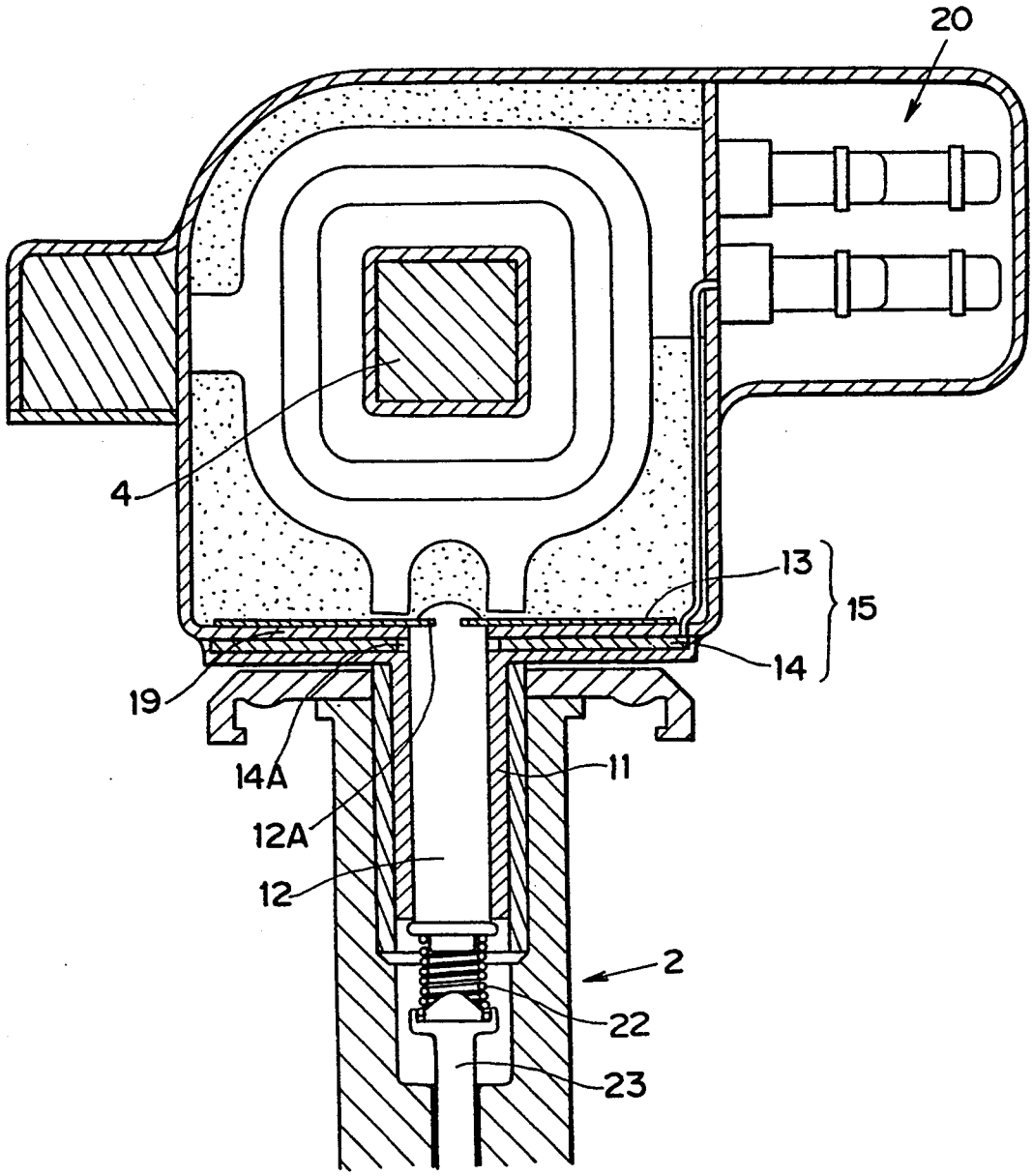
FIG. 4 is a side view enlarging a portion of FIG. 1.

FIGS. 1 through 5 show an ignition coil unit 3 according to a first embodiment of the invention. This embodiment is applied to an ignition system in which a separate ignition coil is provided for a spark plug at each cylinder, and the secondary voltage of the ignition coil is, without the use of an ignition distributor, supplied directly to the spark plug; namely in what is known as the DLI (distributorless ignition) or DI (direct ignition) type ignition system.

In FIGS. 1 through 4, the ignition coil unit 3 is fixed to the top of a spark plug cap 2 which covers a spark plug 1. The ignition coil unit 3 has a metallic core 4, and a primary coil 6 is wound around the core 4 through a bobbin 5, which is made of a synthetic resin material and which has a rectangular cross section. A secondary coil 8 is separately wound around thereon through a bobbin 7 made of the same material and having the same configuration as the first bobbin 5. The core 4, thus wound by coils 6, 8, is housed in a case 9, which is made of a hard and rigid resin such as polybutylene terephtalate (PBT), and is filled with an insulative resin 10 such as epoxy resin through injection molding. As will be understood from FIGS. 1 and 2, a portion of the case 9 surrounding the secondary coil 8 is configured approximately as a rectangular parallelepiped, in conformity with the contour of the secondary coil 8. The case 9 is provided at its bottom with a cylindrical projection 11 which is formed integrally therewith and projects downward. The cylindrical projection 11 houses therein a shaft 12 made of an electrically conductive material. The upper end of the conductive shaft 12 projects into the case 9 and is formed, at a position slightly below its uppermost end, with an annular groove 12A around its circumference. Additionally, the case 9 is provided at its side with a connector section 20 for supplying a primary current to the primary coil 6.

Figure 5:
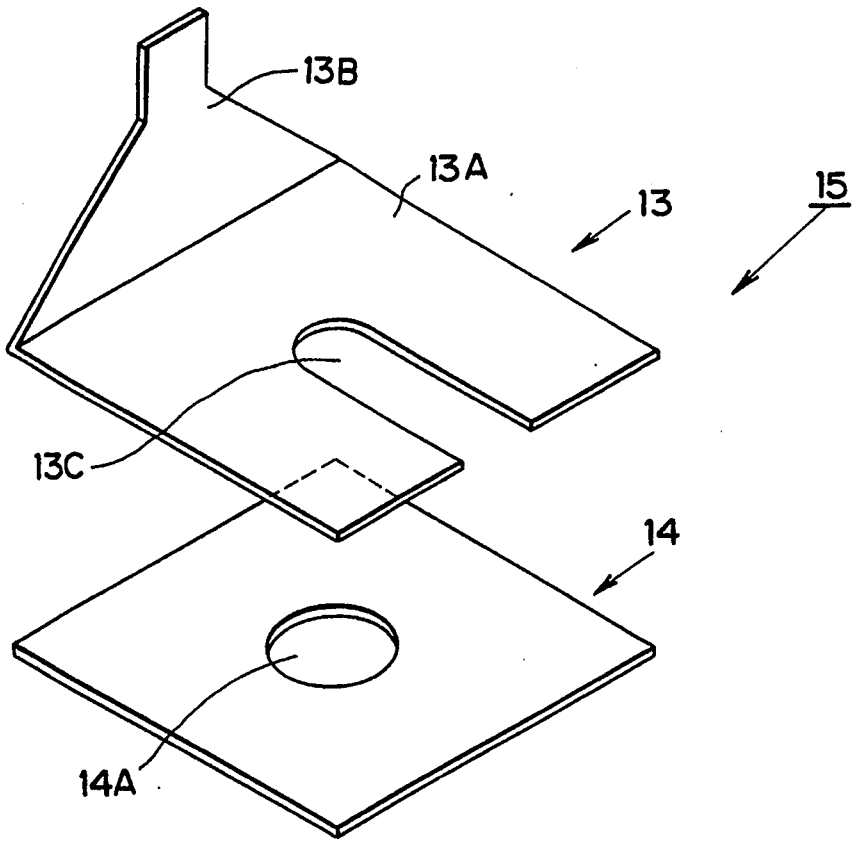
FIG. 5 is a perspective view showing the first and second electrode plates used in FIGS. 1 through 4.

A first electrode plate 13 and a second electrode plate 14 are provided at the bottom of the case 9. The first and second electrode plates 13, 14 are thin plates made of a highly conductive material such as copper, and together constitute a detective capacitor 15 referred to again below. As best shown in FIG. 5, the first electrode plate 13 has an electrode section 13A in a square shape, and a raised section 13B raised at a right angle therefrom. The section 13A is indented from the opposite end to form a cutaway 13C to receive the upper end of the shaft 12 by engaging the plate's cutaway ends with the shaft's annular groove 12A. Thus, the first electrode plate 13 is electrically connected with the shaft 12. On the other hand, the raised section 13B is electrically connected with an output 8A of the secondary coil 8. The first electrode plate 13 is located in the case 9 such that its electrode section 13A is in parallel with the bottom of the case 9.

The second electrode plate 14 is configured to have a square plan similar to that of the electrode section 13A of the first electrode plate 13, and is formed, at its center with a hole 14A whose diameter is made greater than the outside diameter of the shaft 12. The second plate 14 is rested on the bottom of the case 9, and the shaft 12 passes through the hole 14A without contacting the second plate 14. The electrode section 13A of the first plate 13 opposes the second plate 14, separated by a small, constant distance which is filled by an insulator 19. The electrode section 13A of the first plate 13 and the second plate 14 thus constitute the detective capacitor 15 using the insulator 19 as the dielectric. Although the insulator 19 is integrally formed with the case 9 as illustrated, it is alternatively possible to form the dielectric by inserting a member prefabricated separately from the case, or to use the case-filling resin 10 to fill the gap between the electrode section 13A of the first plate and the second plate 14.

The ignition coil unit 3 is then fixed to the spark plug cap 2 at its top. The spark plug cap 2 may be an ordinary one often used in the DLI system. To be more specific, the spark plug cap 2 is integrally formed in the overall shape of a hollow cylinder from polybutylene terephthalate (PBT) or other hard or rigid resin exhibiting excellent heat resistance and electrical insulation properties. The integrally formed hard resin constitutes an insulator body of the cap. The upper part of the hollow portion centered on the longitudinal axis of the spark plug cap 2 constitutes an upper insertion chamber 21 into which the aforesaid cylindrical projection 11 of the ignition coil unit is inserted. The middle part of the cap's hollow portion slidably accommodates a second shaft 23 made of a material suitable for high-voltage conduction. The upper end of the conductive shaft 23 is electrically connected to the first conductive shaft 12 of the ignition coil unit 2 through a spring 22 also made of a conductive material. The lower end of the cap's hollow portion constitutes a cap chamber 24 which includes a connector section 25. The connector section 25 is electrically connected with the shaft 23, and covers and contacts a terminal 1A formed at the top of the spark plug 1. The lower end of the second conductive shaft 23 thus contacts the terminal 1A of the spark plug 1.

In the ignition coil unit 3 with the spark plug cap just mentioned, when a current supplied to the primary coil 6 is interrupted by a signal from an ignition timing control unit (not shown), a high voltage occurs at the secondary coil 8. The high voltage is transmitted to the shaft 12 from the output 8A of the secondary coil 8 via the raised section 13B and the electrode section 13A of the first plate 13, and from the shaft 12 to the spark plug 1 via the spring 22, the second shaft 23, and the connector section 25, resulting in the spark discharge between the spark plug electrodes. At that instance, a voltage is induced in the detective capacitor 15 constituted by the electrode section 13A of the first plate 13 and the second plate 14. This voltage is then capacitively divided, and applied as a detection voltage to a misfire detector (not shown). The misfire detector compares the wave form of the detection voltage with a reference wave form for detecting the presence/absence of misfire.

Here, the detective capacitor 15 is constituted, as repeatedly explained, by the electrode section 13A of the second plate 13 and the first plate 14; both positioned in the space extending from the outside of the secondary coil to the bottom of the case 9. Since the space is sufficiently wide along the bottom of the case 9, it becomes possible to increase the area between the plates as desired to increase the capacitance. Thus it becomes possible to enhance ignition voltage detection accuracy and therefore to enhance the misfire detection. In other words, it becomes possible to raise the detection voltage level against the noise level so as to enhance the S/N ratio, thereby improving detection accuracy.

Further, in the current transmission path starting from the output 8A of the secondary coil 8 and ending at the spark plug 1, the first plate 13 also acts as a portion of the path; i.e., from the secondary coil's output 8A to the shaft 12. No additional lead or wire is therefore needed for the current transmission and the number of components is decreased.

Furthermore, since the first and second plates 13, 14 are embedded in the case 9 integrally with the first and secondary coils 6, 8, there is no danger of positional shifting or deformation due to mechanical vibration, or of being affected by ambient humidity, wetting by leaking water, or fouled with oil or grime. The insulator 19 interposed between the first and second plates 13, 14 has excellent structural durability when compared with the rubber material typically used in the conventional configuration.

Figure 6:
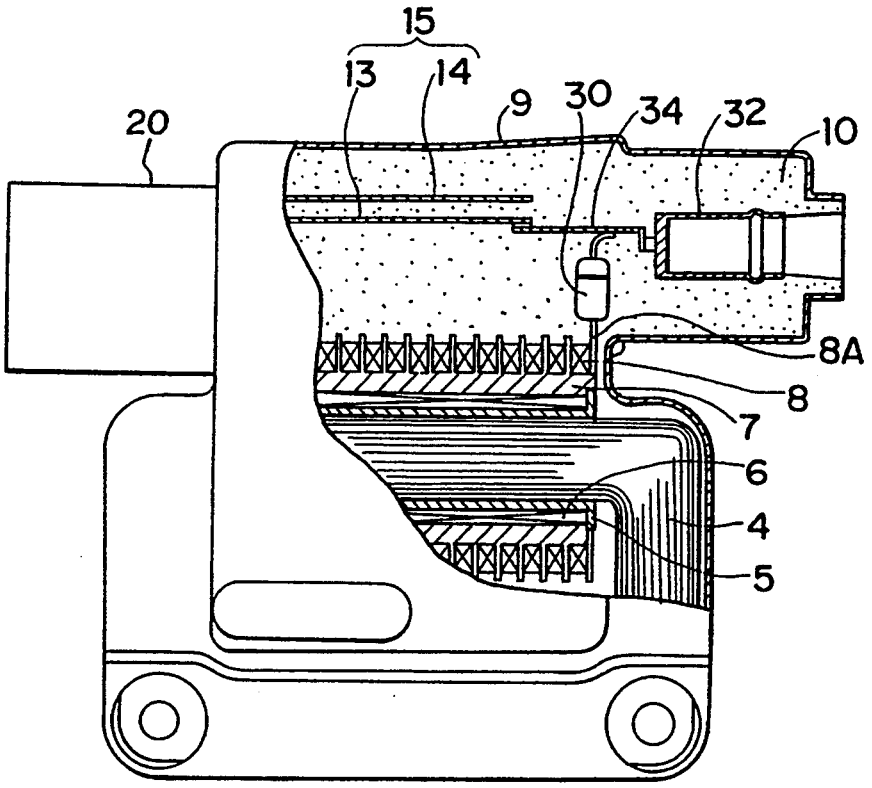
FIG. 6 is a cross-sectional front view of an ignition coil unit according to a second embodiment of the invention.
Figure 7:
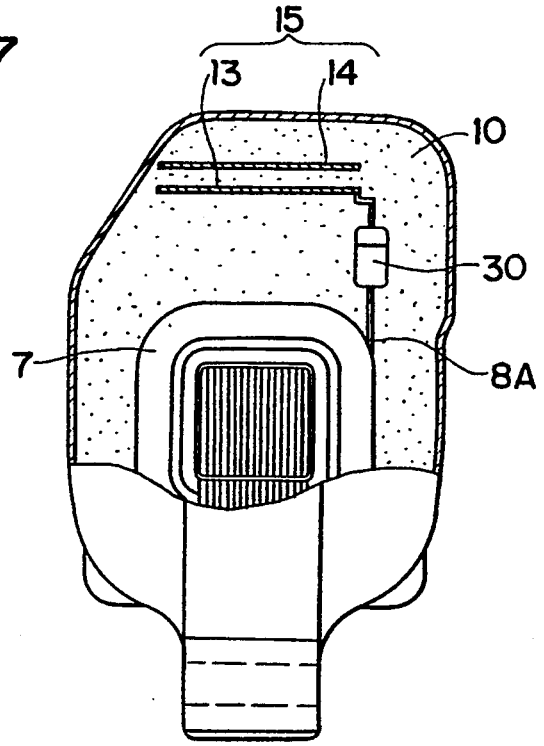
FIG. 7 is a cross-sectional side view of the ignition coil unit illustrated in FIG. 6.

FIGS. 6 and 7 show an ignition coil unit according to a second embodiment of the invention. In the second and proceeding embodiments, the same references will be assigned to the same parts referred to in previous embodiments, and explanations thereof are omitted.

The ignition coil unit disclosed in the second embodiment is most suited for an ignition system using an ignition distributor. As illustrated in the figures, the output 8A of the secondary coil 8 is connected with a secondary connector section 32 through a current reversal blocking diode 30. The case 9 is expanded above the coil 8 to provide an upper section in which the first and second plates 13, 14 are located in parallel with each other and maintain a fixed distance from one another. The first plate 13 is configured to have a square plan and is connected with the secondary connector section 32 through a conductor 34. The second plate 14 has the same configuration as the first plate 13 and is connected with the primary connector section 20 through a lead (not shown). The first and second plates 13, 14 are placed in position by embedding them in the resin 10 in the case 9 at the time of fabricating the coil unit. Therefore, the detective capacitor 15 is constituted by intervening the resin 10 as the dielectric between the first and second plates 13, 14. Instead of the resin 10, it is alternatively possible to interpose between the plates a member made of an insulative material or ceramic. In the ignition coil unit disclosed in the second embodiment, it is also possible to increase the area between the plates to enhance the detection accuracy. The rest of the embodiment is similar to that of the first embodiment.

Figure 8:
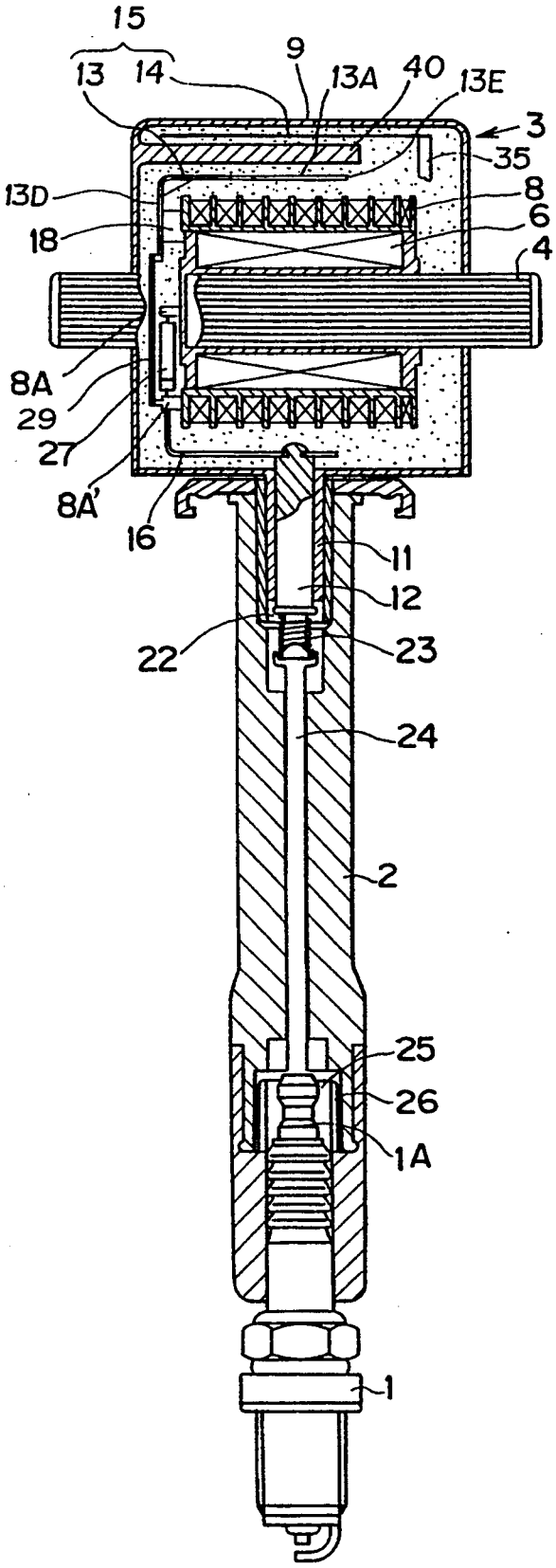
FIG. 8 is a cross-sectional front view of an ignition coil unit according to a third embodiment of the invention.
Figure 9:
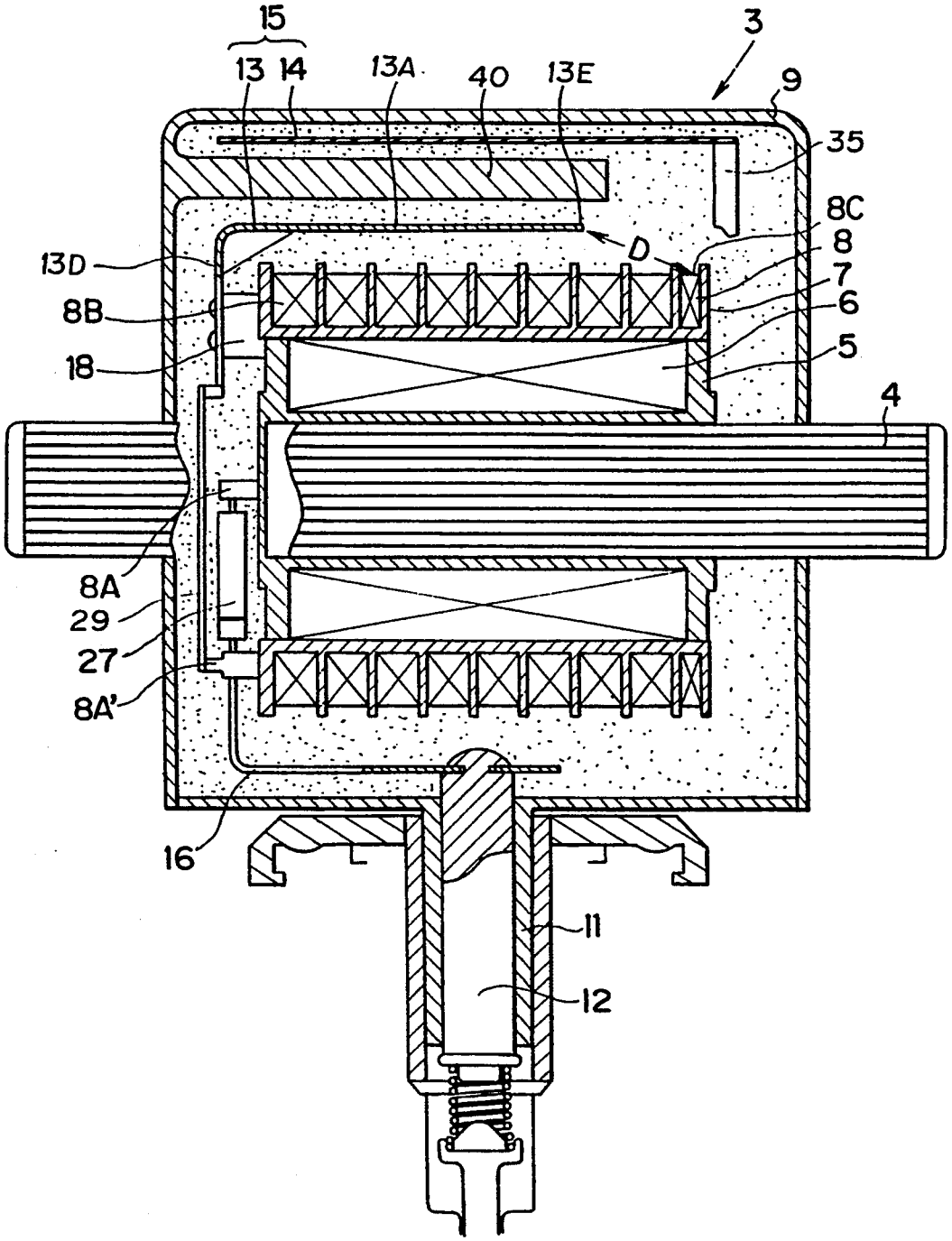
FIG. 9 is a front view enlarging a portion of FIG. 8.
Figure 10:
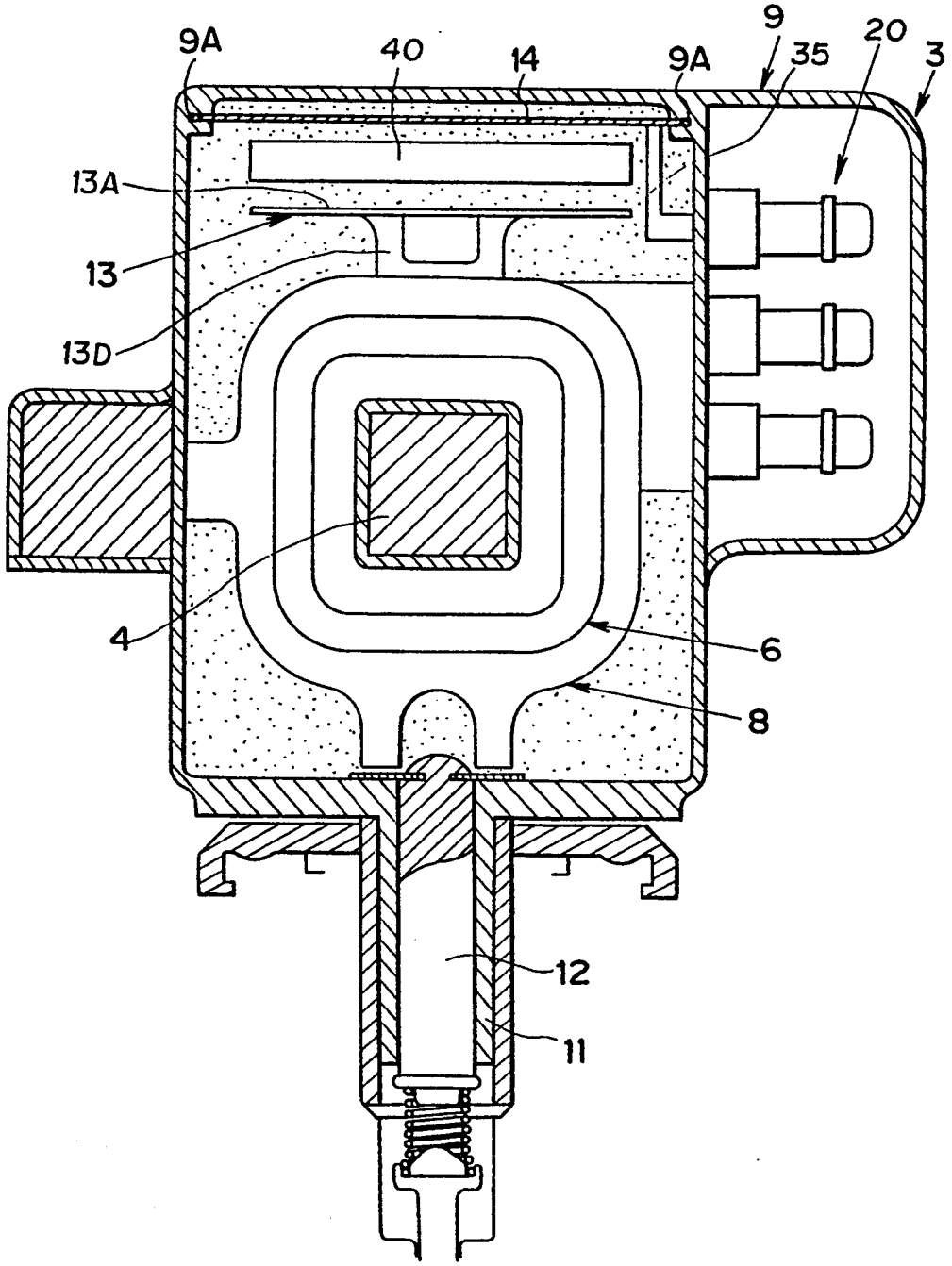
FIG. 10 is a side view enlarging a portion of FIG. 8.

FIGS. 8 through 10 show an ignition coil unit according to a third embodiment of the invention.

Although in the first embodiment, the first and second plates 13, 14 are provided at the lower side of the coils, it is alternatively possible to locate them at the upper or left or right side of the coils. In such an instance, the first plate 13 should preferably be supported, at its end, from the end of either of bobbin 5 or 7, cantilevers therefrom in parallel with the outer surface of the secondary coil 8 and closer to the coil's high voltage end. This is because the first plate 13 is electrically connected with the high voltage output of the secondary coil, and hence is kept at almost the same electric potential level as that of the high voltage of the secondary coil 8. If the distance between the first plate 13 and the secondary coil's high voltage end is small, no problem will occur since the potential difference therebetween is slight. However, if the distance between the first plate 13 and the secondary coil's low voltage end (the one nearer to the ground potential) is small, there may be a danger of generating a corona discharge or a current leakage therebetween. It is therefore preferable for the first plate to be located at a position nearer to the high voltage end, rather than the low voltage end, of the secondary coil. For that reason, the first plate 13 should preferably be fixed at its end at the secondary coil's high voltage end of the bobbin 5 or 7, in such a manner that the first plate 13 cantilevers therefrom in parallel with the outer surface of the secondary coil, while keeping its free end at a predetermined distance from the secondary coil's low voltage end. The second plate 14 will be located at a position parallel with the first plate 13.

On the other hand, the fabrication of the ignition coil unit is conducted by placing the components, including the first and second plates and the coils, in position in the case 9 in advance and injecting or filling the resin 10 therein. As a result, there is a possibility that the cantilevered first plate 13 might be deformed due to the pressure of the injected resin and its free end may come close to or in contact with the second plate 14. Any insufficient attaching or configurational error of the first plate will also result the same problem. If this happens, a corona discharge or a current leakage may occur, affecting the signal processing at a later stage. The third embodiment aims to solve the problems.

In the third embodiment, differently from the first embodiment, the shaft 12, projecting into the case 9, is connected with the output 8A of the secondary coil 8 through a conductor 16. A diode 27 is provided in the path for preventing a reversal of current flow. The first plate 13 and the second plate 14, therefore constituting the detective capacitor 15, are located at the upper side of the coils. The first plate 13 has an "L" shaped cross section and is fixed at its end 13D to the primary coil's bobbin 5 at a position close to the high voltage end 8B of the secondary coil 8, through a support 18 made of an insulative material. The first plate 13 has the electrode section 13A which extends from the base end 13D while bending approximately at a right angle toward the low voltage end 8C of the secondary coil 8; following the coil's outer surface. It should be noted here the free end 13E of the first plate 13 is kept a fixed distance D from the secondary coil's low voltage end 8C. The first plate 13 is connected, at its base end 13D, with the output 8A' of the secondary coil 8 through a conductor 29.

The second plate 14 is placed in the close proximity of the inner surface of the top wall of the case 9, in parallel with the electrode section 13A of the first plate 13. The second plate 14 is shaped to have a square plan and, as shown in FIG. 10, is secured in position by inserting its ends in grooves 9A, 9A formed at the corners of the case 9. The second plate 14 is electrically connected with the connector section 20 through a conductor 35.

As illustrated, a partition 40 is interposed between the first plate 13 and the second plate 14. The partition 40 is made as a portion of the case 9 and hence is made of the same insulative material such as PBT. The partition 40 thus projects from the case wall toward the space defined between the plates 13, 14. After the coil unit is fabricated, the resin 10 fills the rest of the space. Therefore, the detective capacitor 15 is formed between the plates 13, 14, using the partition 40 and the resin 10 as the dielectric.

With this arrangement, similar to the foregoing embodiments, the plate area can be increased as desired to enhance the detection accuracy. The distance between the free end 13E of the plate 13 and the secondary coil's low voltage end 8C is kept apart by the distance D so that no corona discharge or current leakage will occur therebetween. In addition, during fabrication of the coil unit, when the resin 10 is injected into the case, since the partition 40 is already present, the first plate 13 is thus prevented from being deformed or having its free end 13E come close to or in contact with the second plate 14. The partition 40 can also prevent the same problems from occurring due to assembly or configurational error or the like. It should be noted that the partition can be formed separately from the case 9 using an insulative material such as hard resin, hard rubber or a ceramic etc., although it is advantageous in manufacturing to form it integrally with the case 9.

Figure 11:
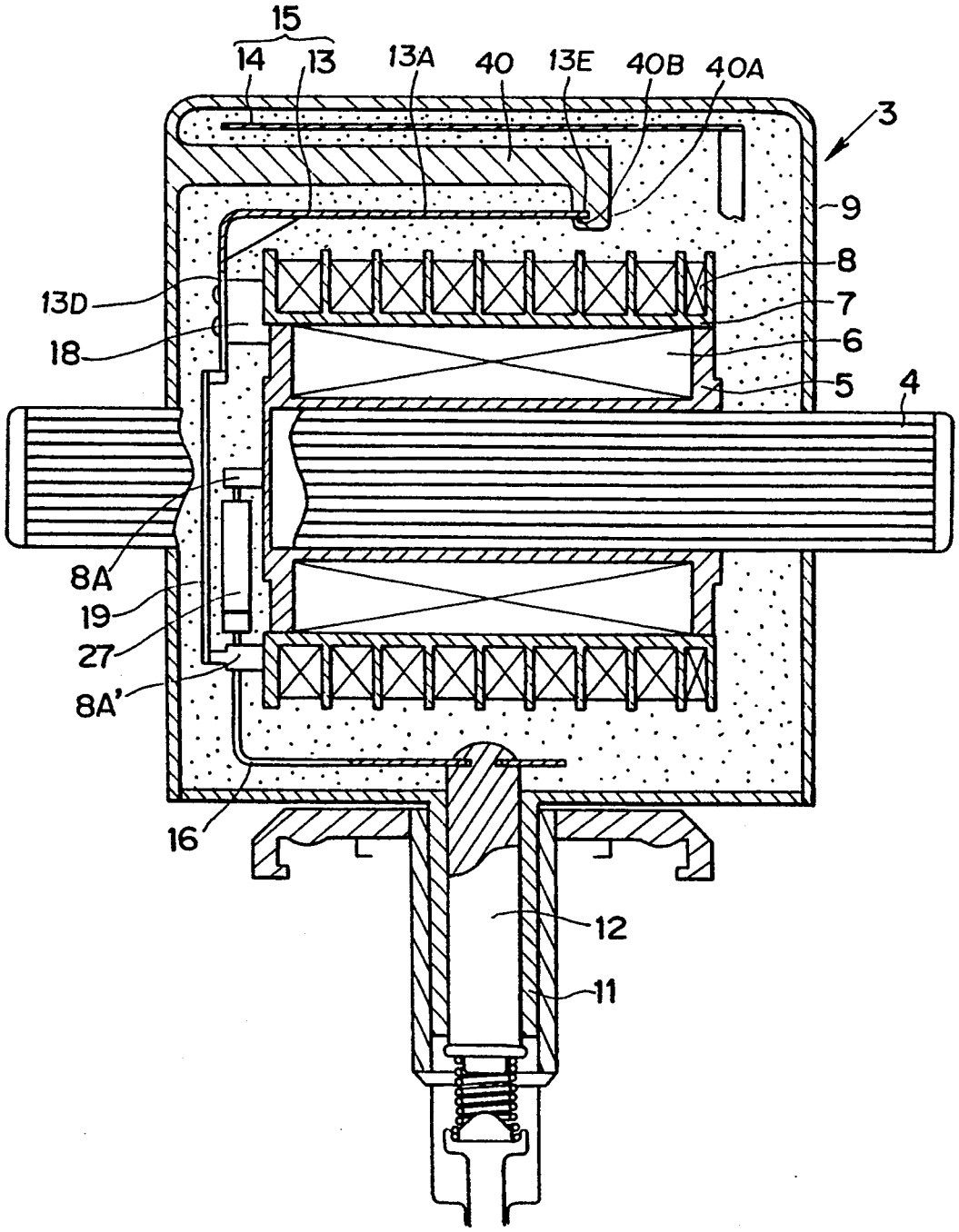
FIG. 11 is an enlarged cross-sectional front view of an ignition coil unit according to a fourth embodiment of the invention.
Figure 12:
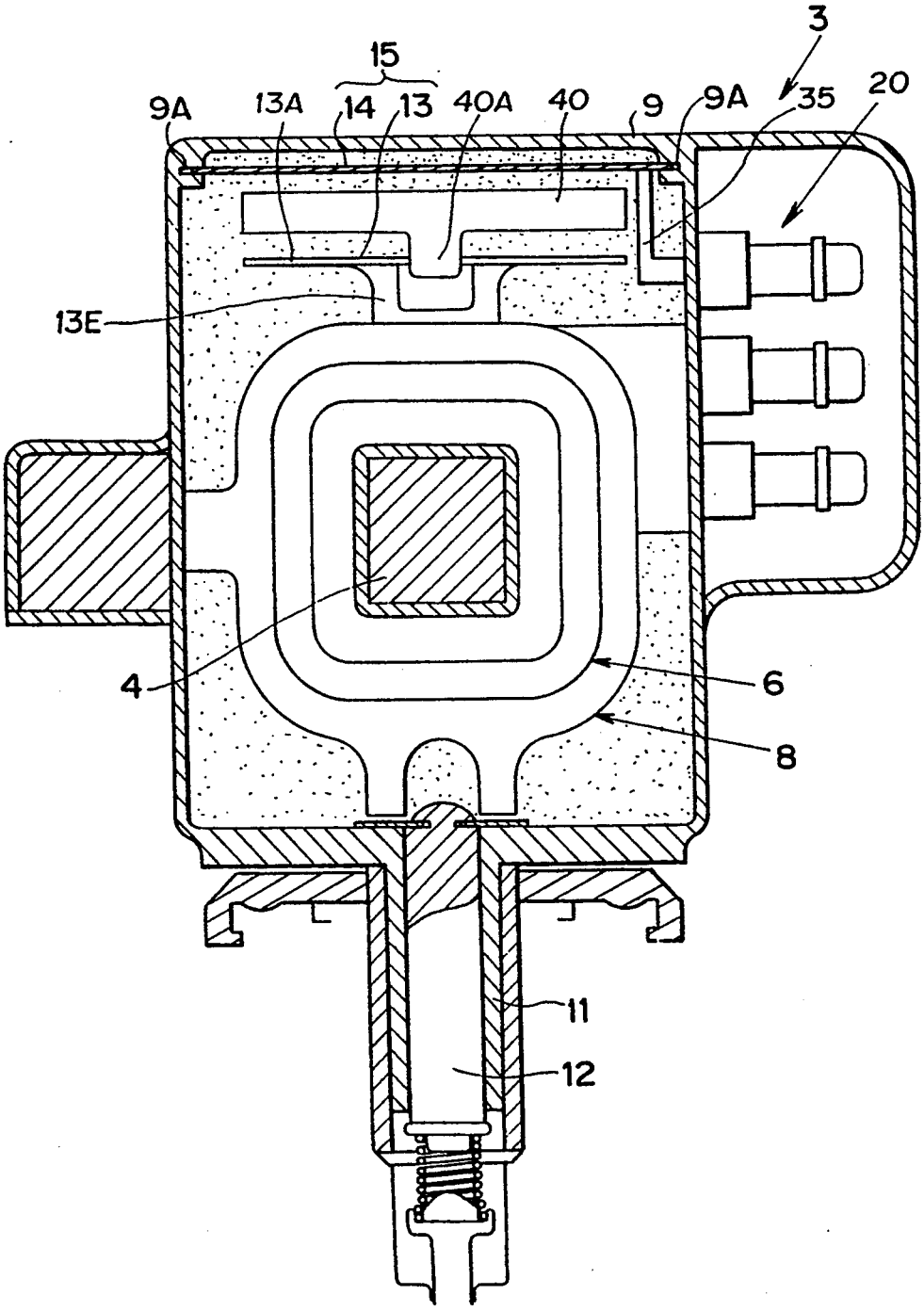
FIG. 12 is an enlarged cross-sectional side view of the ignition coil unit illustrated in FIG. 11.

FIGS. 11 and 12 show an ignition coil unit according to a fourth embodiment of the invention. In the fourth embodiment, the partition 40 is provided with a projection 40A which slightly projects toward the secondary coil 8. A groove 40B is formed in the projection 40A to receive the free end 13E of the first plate 13. Thus, the first plate 13 is secured in position more firmly than that in the third embodiment, increasing structurally stability against the deformation at resin injection or the like. The rest of the embodiment is the same as in the foregoing embodiments.

Figure 13:
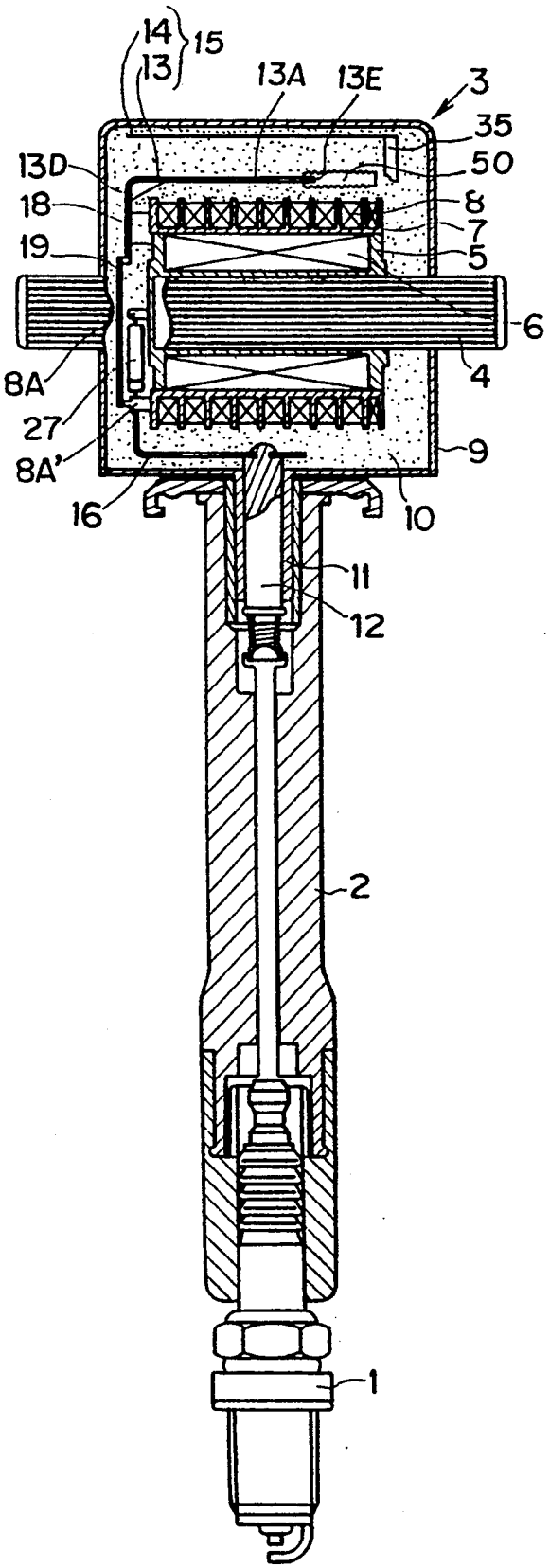
FIG. 13 is a cross-sectional front view of an ignition coil unit according to a fifth embodiment of the invention.
Figure 14:
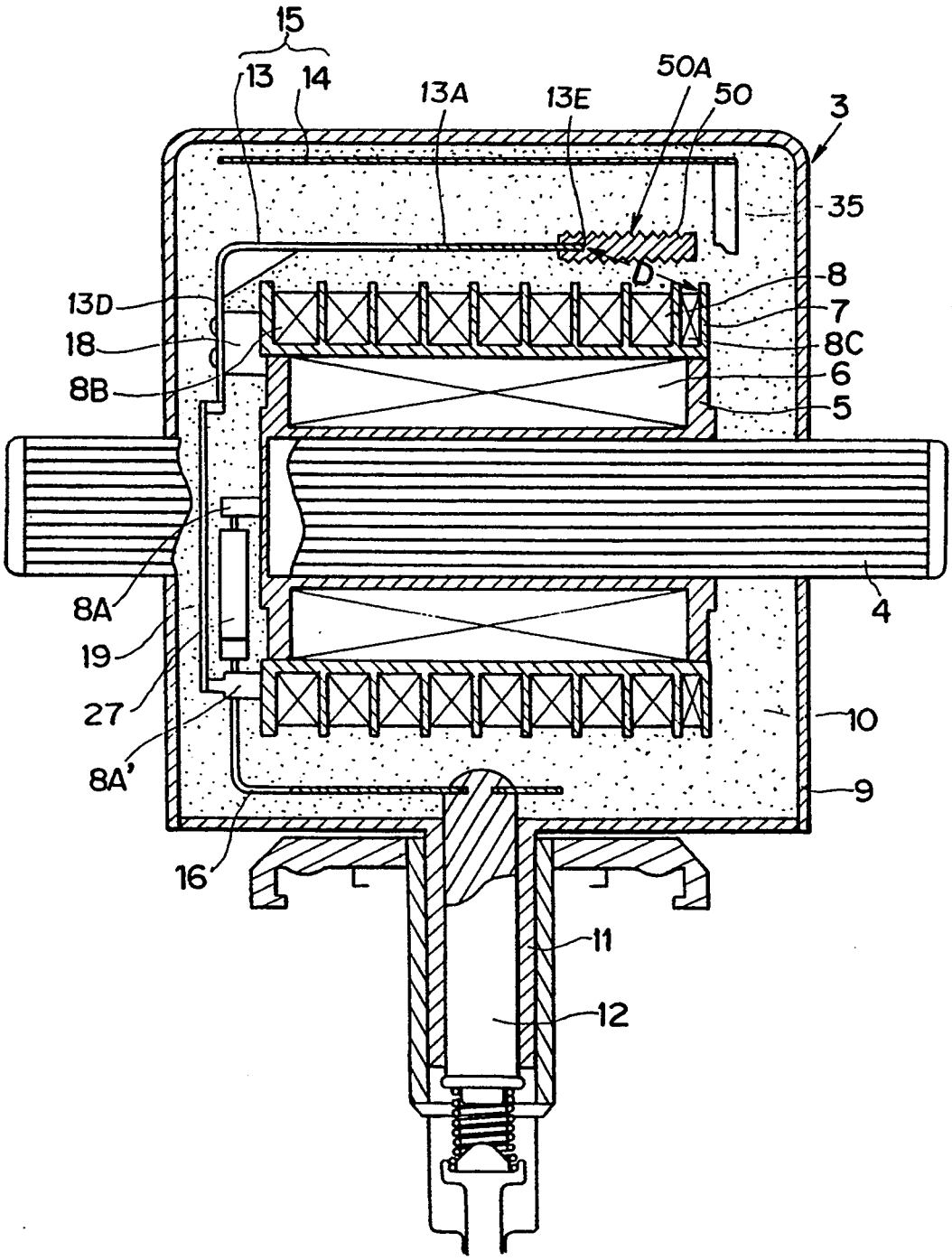
FIG. 14 is an enlarged cross-sectional front view of the ignition coil unit illustrated in FIG. 13.
Figure 15:
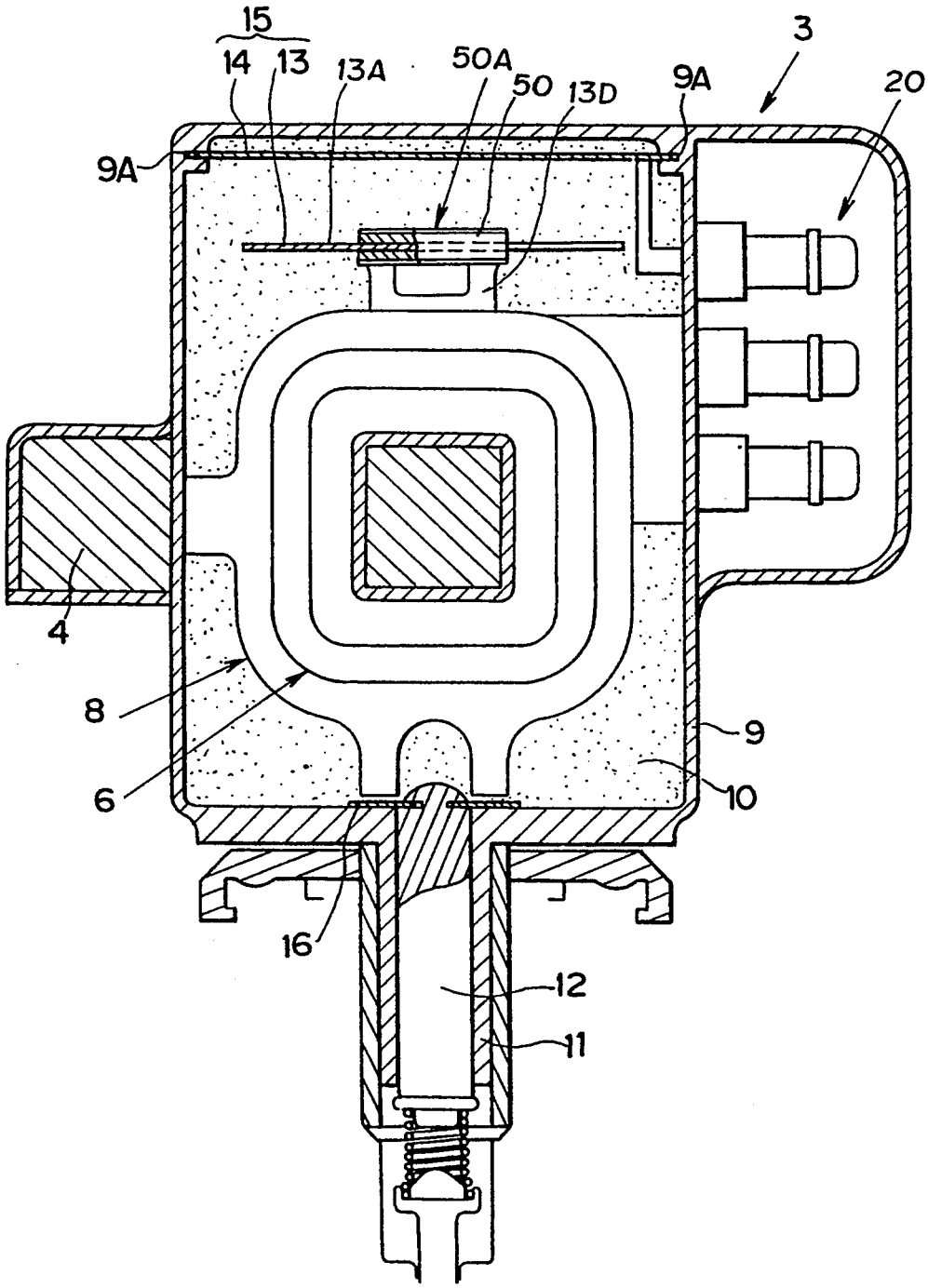
FIG. 15 is an enlarged cross-sectional side of the ignition coil unit illustrated in FIG. 13.

FIGS. 13 through 15 show an ignition coil unit according to a fifth embodiment of the invention.

In the fifth embodiment, the first plate 13 is provided, at its free end 13E, with a protector 50 made of the same material as that of the case 9 such as PBT. The protector 50 is fixed to center portion of the free end 13E of the second plate 13 as illustrated in FIG. 15, and extends from the end 13E as illustrated in FIG. 14. The surface of the protector 50 is formed with corrugations 50A (or a similarly variegated profile) as illustrated. In the fifth embodiment no partition is used, and instead, the protector 50 can serve the same function as the partition 40 used in the third embodiment.

When a hard resin such as PBT is used as the material for the protector 50, such a resin's poor bonding properties with the mold resin 10 (epoxy resin or the like), are likely to cause a separation between the protector's surface and the resin 10. If this happens and if the protector's tip comes in contact with the second plate 14, a discharge might occur between the plates via the protector's separated surface. Since, however, the protector 50 is formed with the corrugations 50A, and the surface area of the protector is thereby made larger, the possibility of that problem happening is thus decreased.

Figure 16:
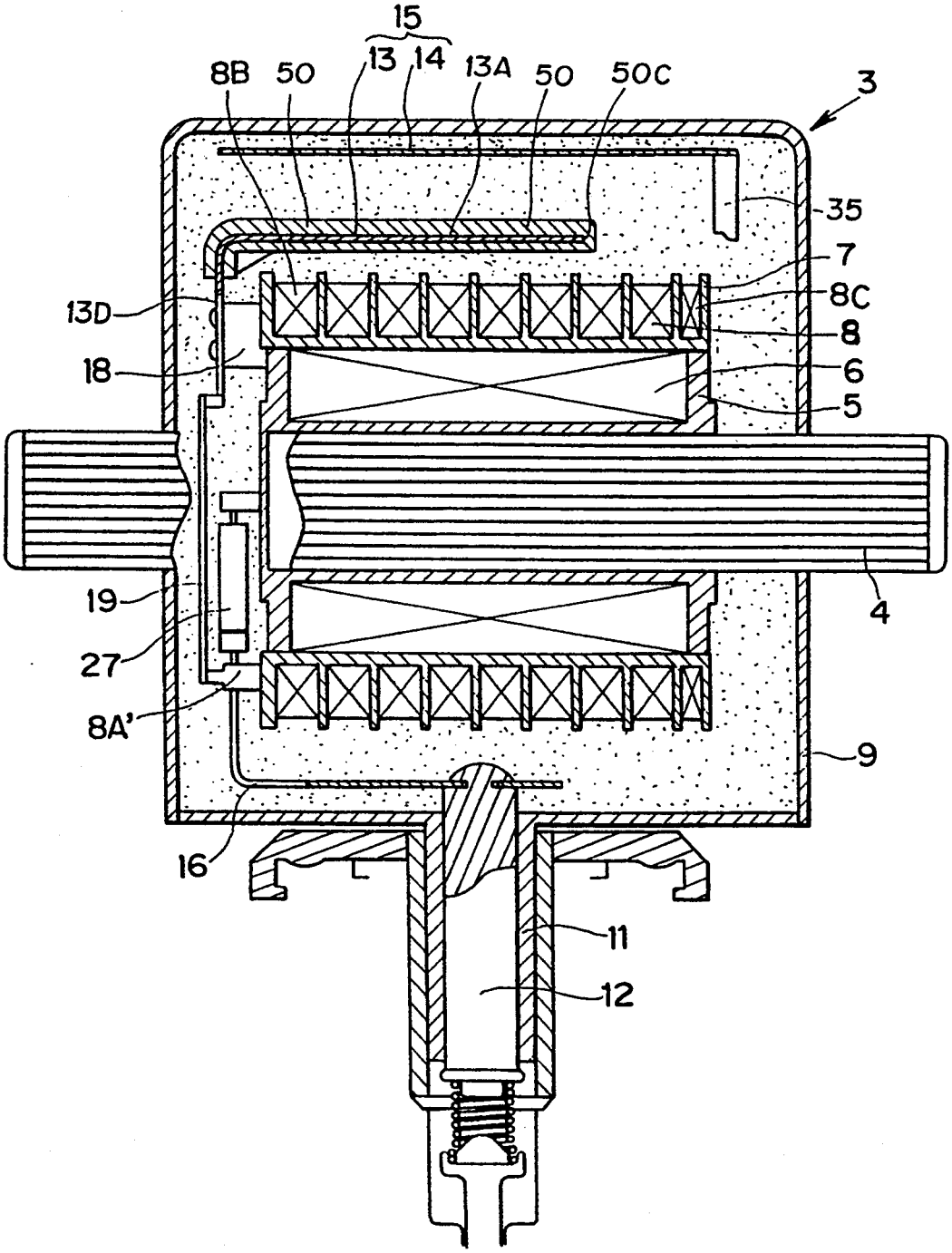
FIG. 16 is an enlarged cross-sectional front view of an ignition coil unit according to a sixth embodiment of the invention.
Figure 17:
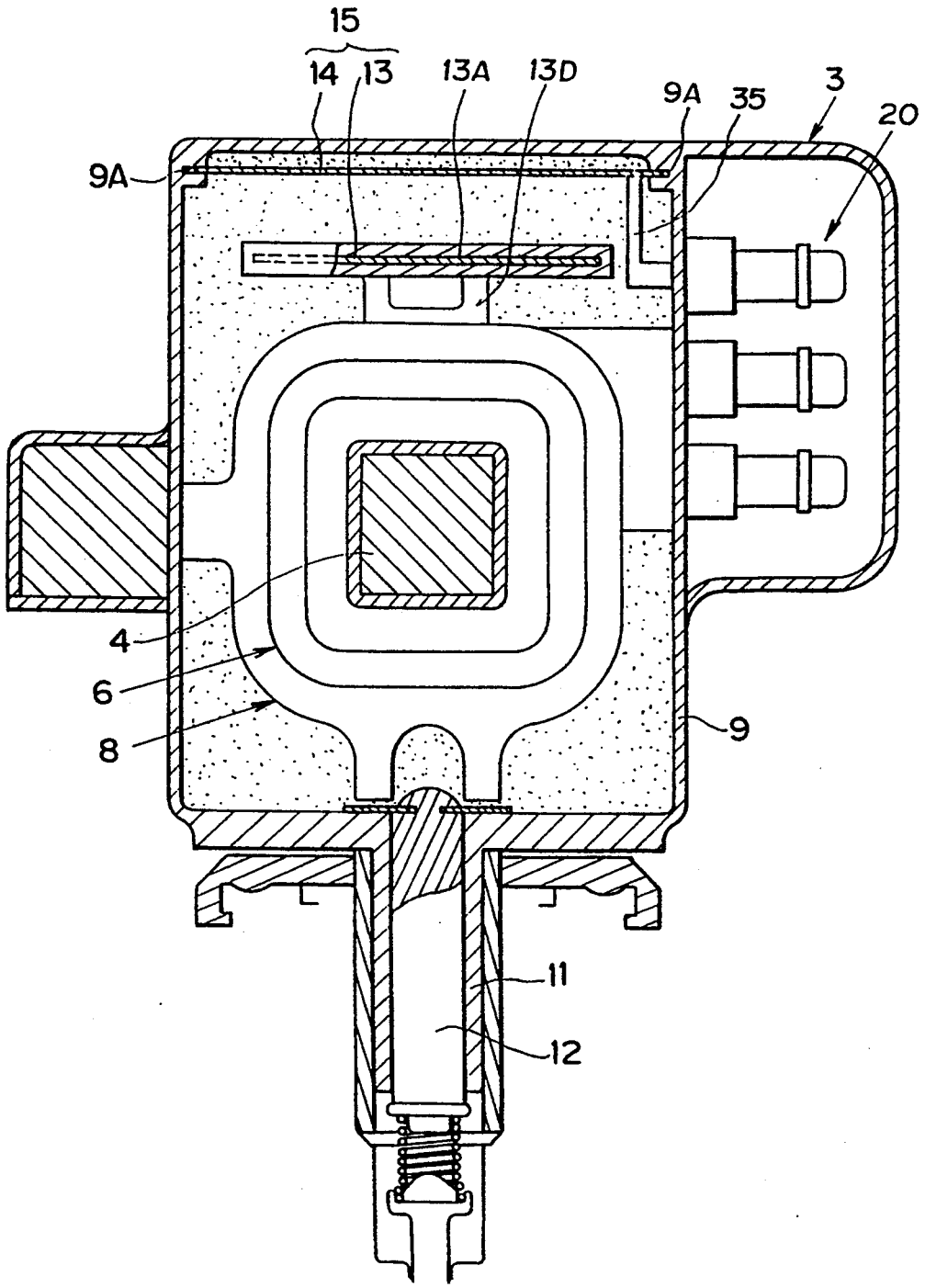
FIG. 17 is an enlarged cross-sectional side view of the ignition coil unit illustrated in FIG. 16.

FIGS. 16 and 17 show an ignition coil unit according to a sixth embodiment of the invention.

In the sixth embodiment, the protector 50 is elongated such that it covers almost the entire electrode section 13E of the first plate 13. The rest of the embodiment is the same as in the foregoing embodiments. It is of course possible to provide corrugations on the protector 50, similar to those in the fifth embodiment.

In the fifth and sixth embodiments, it should be noted that the configuration of the protector is not limited to those disclosed and any other configuration may be provided as desired.

Figure 18:
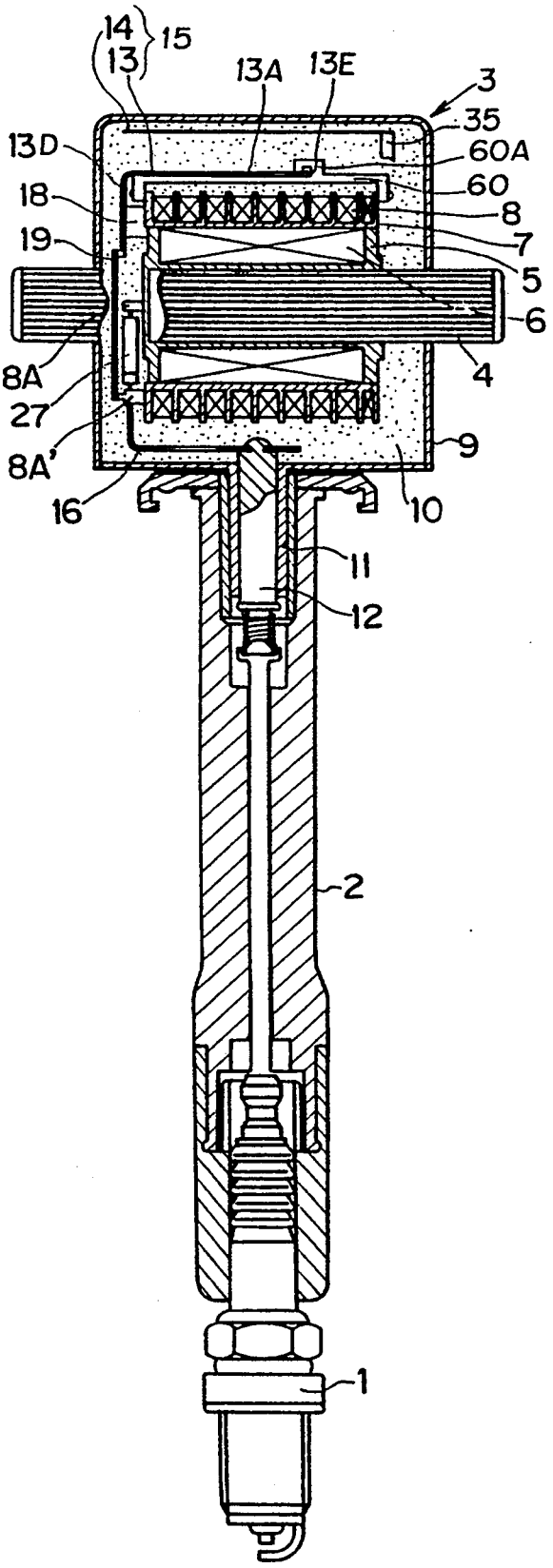
FIG. 18 is a cross-sectional front view of an ignition coil unit according to a seventh embodiment of the invention.
Figure 19:
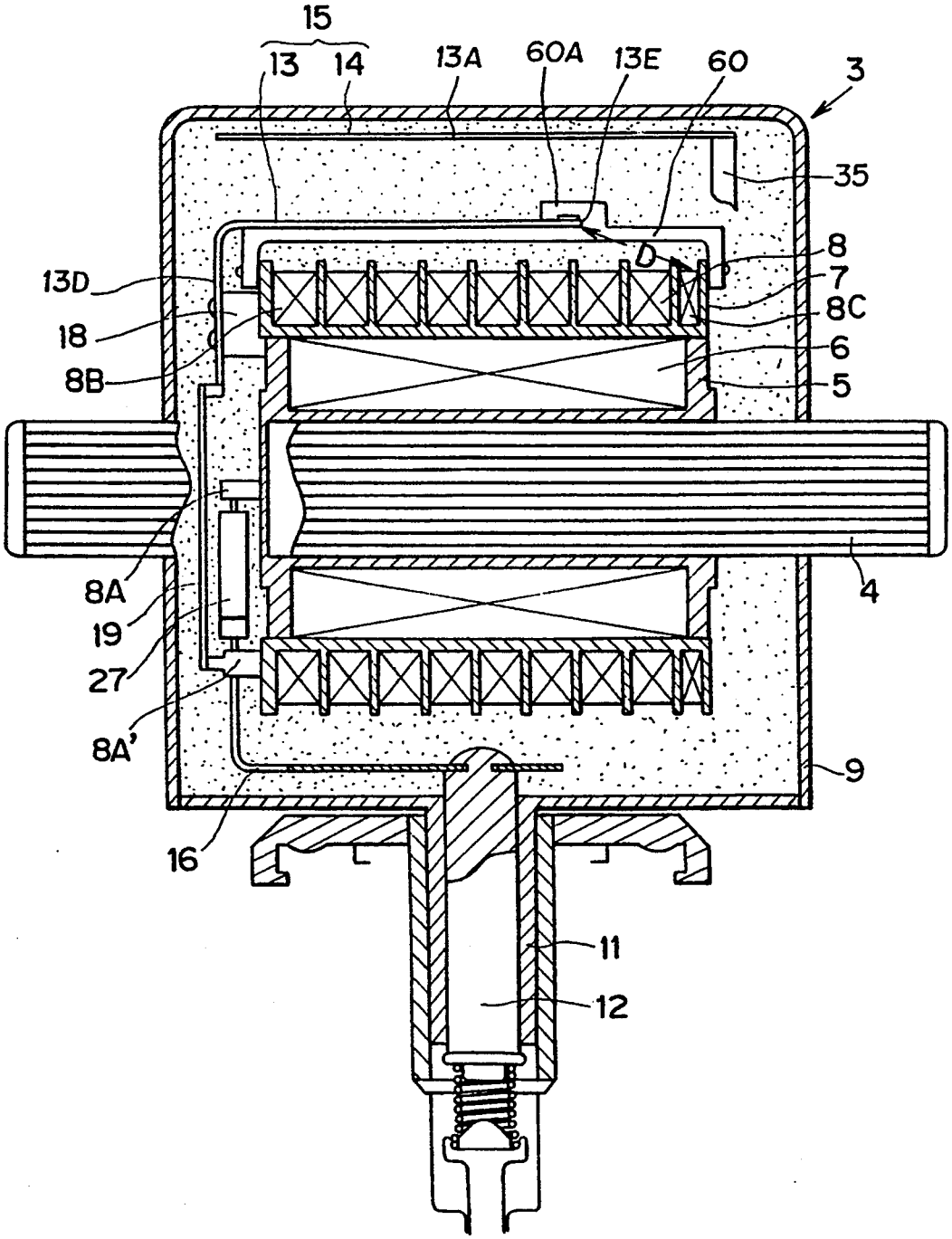
FIG. 19 is an enlarged cross-sectional front view of the ignition coil unit illustrated in FIG. 18.
Figure 20:
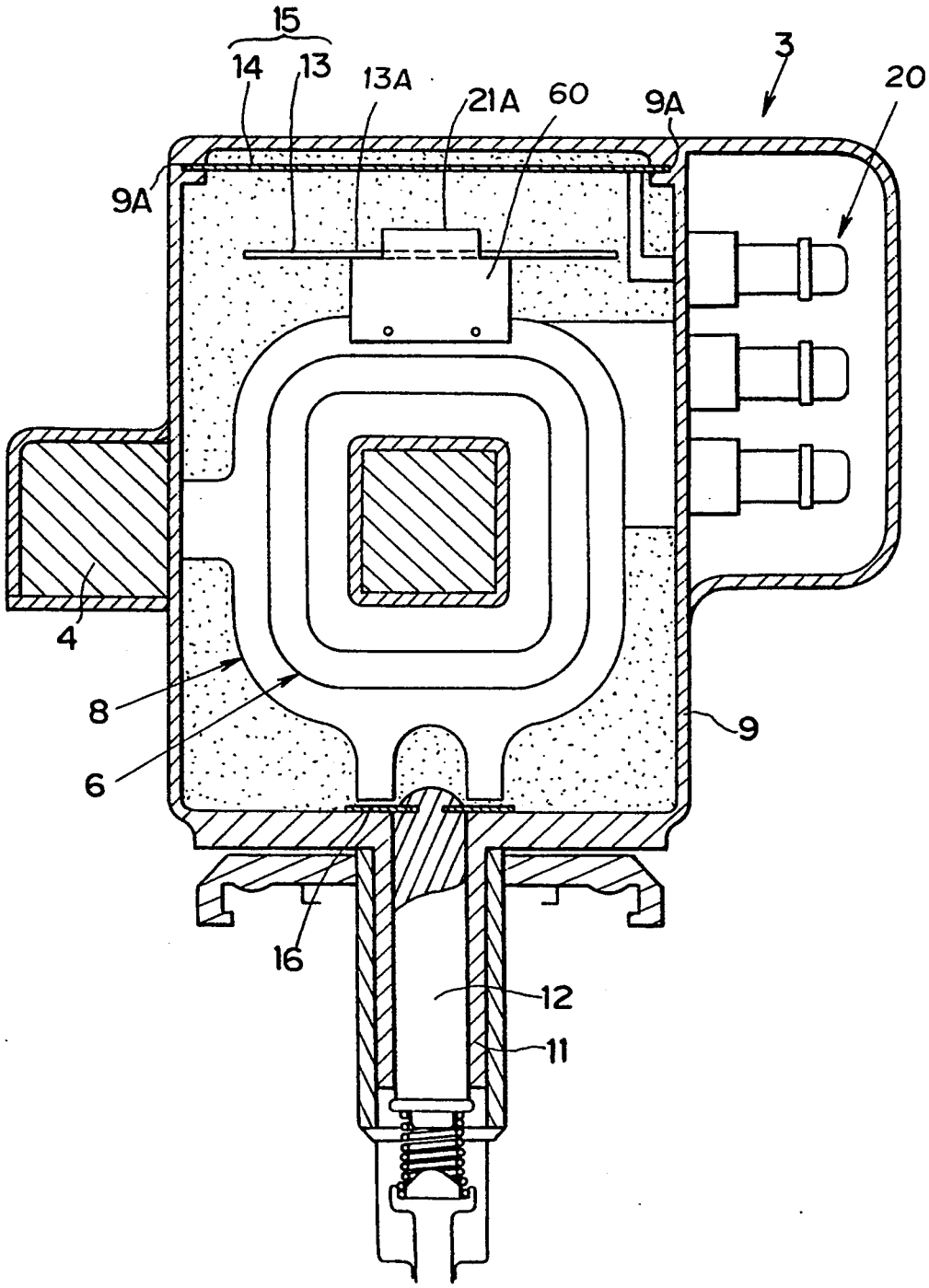
FIG. 20 is an enlarged cross-sectional side view of the ignition coil unit illustrated in FIG. 18.
Figure 21:
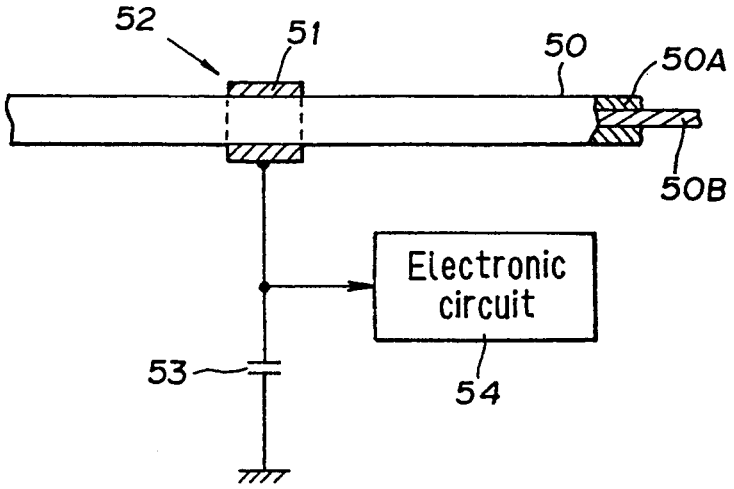
FIG. 21 is a schematic view showing a prior art misfire detector.

FIGS. 18 through 20 show an ignition coil unit according to a seventh embodiment of the invention.

In the seventh embodiment, instead of the protector used in the fifth to sixth embodiments, a retainer 60 is used. More specifically, the retainer 60 is made of an insulative material such as a hard resin, a hard rubber or a ceramic, and is configured such that it bridges the ends 8B and 8C of the secondary coil 8. The retainer 60 has a projecting lip 60A which projects from the surface facing the inner surface of the case 9. The first plate 13 rests on the retainer and secured in position by engaging its end 13E with the projecting lip 60A.

With this arrangement, the first plate 13 is prevented from being deformed not only toward the second plate 14 but also toward the coil 8. The rest of the embodiment is the same as in the foregoing embodiments.

In the foregoing third through seventh embodiments, although the first and second plates 13, 14 are placed at the upper side of the coils 6, 8, it is alternatively possible to place them at the right or left side (as viewed in FIG. 10) of the coils 6, 8.

The present invention has thus been shown and described with reference to the specific embodiments. However, it should be noted that the present invention is in no way limited to the details of the described arrangements; changes and modifications may be made without departing from the scope of the appended claims.

What is claimed is:

1. An ignition coil unit for an internal combustion engine, including;

a core;

a primary coil and a secondary coil wound around the core; and a case housing the core and the primary and secondary coils and filled with an insulative material;

wherein the improvement comprises:

a first conductive electrode plate placed in the case and electrically connected with the output of the secondary coil;

a second conductive electrode plate placed in the case in parallel with the first conductive electrode plate while maintaining a predetermined distance therefrom; and an insulator interposed between the first and second conductive electrode plates such that a capacitor is formed therewith using the insulator as a dielectric.

2. An ignition coil unit according to claim 1, wherein said insulator is integrally formed with said case.

3. An ignition coil unit according to claim 1, wherein the ignition coil unit is fixed to a cap covering the terminal of a spark plug of said engine and having a circuit for carrying an ignition voltage generated by said secondary coil to the terminal of the spark plug.

4. An ignition coil unit according to claim 3, wherein said first conductive electrode plate is in said circuit.

5. An ignition coil unit according to claim 3, wherein the ignition coil unit is configured for a direct ignition system.

6. An ignition coil unit for an internal combustion engine, including;

a core;

a primary coil and a secondary coil wound around the core; and a case housing the core and the primary and secondary coils and filled with an insulative material;

wherein the improvement comprises:

a first conductive electrode plate placed in the case and electrically connected with the output of the secondary coil; and a second conductive electrode plate placed in the case in parallel with the first conductive electrode plate while maintaining a predetermined distance therefrom such that a capacitor is formed therewith using at least the insulative material as a dielectric.

7. An ignition coil unit according claim 6, wherein said first conductive electrode plate is fixed, at its end, at a position close to the higher voltage end of said secondary coil such that it cantilevers therefrom in parallel with said second conductive electrode plate.

8. An ignition coil unit according to claim 7, wherein a partition made of an insulative material is interposed between said first and second conductive electrode plates.

9. An ignition coil unit according to claim 8, wherein said partition is integrally formed with said case.

10. An ignition coil unit according to claim 8, wherein said first conductive electrode plate is fixed to said partition at its free end.

11. An ignition coil unit according to claim 7, wherein said first conductive electrode plate is covered at least partially by a protector made of an insulative material.

12. An ignition coil unit according to claim 11, wherein said first conductive electrode plate is covered by said protector at its free end.

13. An ignition coil unit according to claim 11, wherein said first conductive electrode plate is covered by said protector over most of its length.

14. An ignition coil unit according to claim 11, wherein said protector is formed with a variegated surface.

15. An ignition coil unit according to claim 7, wherein a retainer is fixed to a bobbin of said secondary coil such that said first conductive electrode plate rests thereon.

16. An ignition coil unit according to claim 15, wherein said first conductive electrode plate is fixed to said retainer at said plate free end.

17. An ignition coil unit according to claim 7, wherein said first conductive electrode plate cantilevers from said position while maintaining a predetermined distance between its free end and the lower voltage end of said secondary coil.

18. An ignition coil unit according to claim 6, wherein the ignition coil unit is fixed to a cap covering the terminal of a spark plug, and has a circuit for carrying an ignition voltage generated by said secondary coil to the terminal of the spark plug.

19. An ignition coil unit according to claim 18, wherein said first conductive electrode plate is in said circuit.

20. An ignition coil unit according to claim 19, wherein the ignition coil unit is configured for a direct ignition system.

* * * * *